US007784251B2

(12) United States Patent
Seidita

(10) Patent No.: US 7,784,251 B2
(45) Date of Patent: Aug. 31, 2010

(54) CROWN-LIKE TWIST-OFF CLOSURE

(75) Inventor: Thomas M. Seidita, Mechanicsville, VA (US)

(73) Assignee: Orbist Closures Switzerland GmbH, Reinach (CH)

( * ) Notice: Subject to any disclaimer, the term of this patent is extended or adjusted under 35 U.S.C. 154(b) by 509 days.

(21) Appl. No.: 10/322,885

(22) Filed: Dec. 18, 2002

(65) Prior Publication Data

US 2003/0084648 A1 May 8, 2003

Related U.S. Application Data

(62) Division of application No. 09/946,049, filed on Sep. 4, 2001.

(51) Int. Cl.
*B65B 7/28* (2006.01)

(52) U.S. Cl. ..... 53/471

(58) Field of Classification Search ..... 215/321
See application file for complete search history.

(56) References Cited

U.S. PATENT DOCUMENTS 3,254,785 A * 6/1966 Lovell ..... 215/305
4,055,266 A 10/1977 Amabili
4,402,415 A * 9/1983 Hopley ..... 215/48
5,090,581 A * 2/1992 Rose et al. ..... 215/48
5,263,600 A 11/1993 Henning
5,415,306 A 5/1995 Luch et al.
5,715,959 A * 2/1998 Pfefferkorn et al. ..... 215/252
5,749,201 A * 5/1998 Cochrane ..... 53/281
5,884,790 A * 3/1999 Seidita ..... 215/330
5,984,125 A * 11/1999 Price et al. ..... 215/253
6,006,933 A 12/1999 Henning et al.
D418,757 S 1/2000 Reidenbach
6,116,443 A * 9/2000 Parrinello ..... 215/252
6,176,382 B1 * 1/2001 Bazlur ..... 215/373
D448,297 S 9/2001 Sindermann
6,457,299 B1 * 10/2002 Schwenke et al. ..... 53/510
6,502,369 B1 * 1/2003 Andison et al. ..... 53/432
6,659,298 B2 * 12/2003 Wong ..... 215/373
2004/0211744 A1 * 10/2004 Marzokah ..... 215/252

* cited by examiner

*Primary Examiner*—Brian D Nash
(74) *Attorney, Agent, or Firm*—Knoble Yoshida & Dunleavy, LLC

(57) ABSTRACT

A closure cap that is particularly suited for use with plastic containers in packaging malt based beverages such as beer and ale includes an upper portion and a generally cylindrical sidewall that depends downwardly from the upper portion. The cylindrical sidewall defines a threaded inner surface, which permits the closure cap to be threaded onto a threaded finish portion of a container. Most advantageously, the outer surface of the cylindrical sidewall is stylized to resemble a conventional crown closure. In the disclosed embodiment this is accomplished by molding a plurality of fluted ribs into the outer surface of the cylindrical sidewall. A method of packaging a beverage and a packaging assembly is also disclosed.

18 Claims, 2 Drawing Sheets

CROWN-LIKE TWIST-OFF CLOSURE

This is a divisional of prior application Ser. No. 09/946,049 filed on Sep. 4, 2001, the disclosure of which is hereby incorporated as if set forth fully herein.

BACKGROUND OF THE INVENTION

1. Field of the Invention

This invention relates to packaging technology, and more specifically to twist off type closures of the type that are commonly used in the packaging of consumer beverages.

2. Description of the Related Technology

Twist-off type closures have become quite common and are most often used to seal plastic molded containers of the type that have a threaded finish portion. Such containers are widely used in packaging popular soft drinks, bottled water and other consumer beverages.

Malt based alcoholic beverages such as beer and ale have long been marketed to the public in either glass bottles or metal cans, and there has been resistance in the industry to the idea of packaging such beverages in plastic containers, despite many advantages that would be inherent in doing so. In comparison with glass bottles, plastic is shatterproof, lightweight and is more easily formable into specialized shapes.

One component of the reluctance of some in the industry to make a commitment to plastic bottle packaging is that conventional closures for plastic containers have a look and feel that is reminiscent to many consumers of soft drinks, and not of a quality malt beverage. In effect, many consumers are felt to associate conventional packaging, such as the metal crown closure that is usually used to seal beer bottles, with the beverage itself.

A need exists for an improved packaging assembly for malt beverages and other products that is less likely to shatter than a glass bottle, is relatively lightweight and that is more acceptable to consumers of such products than conventional twist off type closures.

SUMMARY OF THE INVENTION

Accordingly, it is an object of the invention to provide an improved packaging assembly for malt beverages and other products that is less likely to shatter than a glass bottle, is relatively lightweight and that is more acceptable to consumers of such products than conventional twist off type closures.

In order to achieve the above and other objects of the invention, a method of packaging a beverage according to a first aspect of the invention includes steps of providing a container that has a threaded finish portion; providing a closure cap having an upper portion and a generally cylindrical sidewall depending downwardly from the upper portion, the cylindrical sidewall defining a threaded inner surface, and wherein the cylindrical sidewall further has an outer surface that is stylized to resemble a conventional crown closure; at least partially filling the container with a beverage; and installing the closure cap onto the finish portion of the container.

According to a second aspect of the invention, a packaging assembly includes a container having a threaded finish portion; and a closure cap mounted on the threaded finish portion of the container, the closure cap comprising an upper portion and a generally cylindrical sidewall depending downwardly from the upper portion, the cylindrical sidewall defining a threaded inner surface that is mated with the threaded finish portion, and wherein the cylindrical sidewall further has an outer surface that is stylized to resemble a conventional crown closure.

A closure cap according to a third aspect of the invention includes an upper portion; and a generally cylindrical sidewall depending downwardly from the upper portion, the cylindrical sidewall defining a threaded inner surface, and wherein the cylindrical sidewall further has an outer surface that is stylized to resemble a conventional crown closure.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
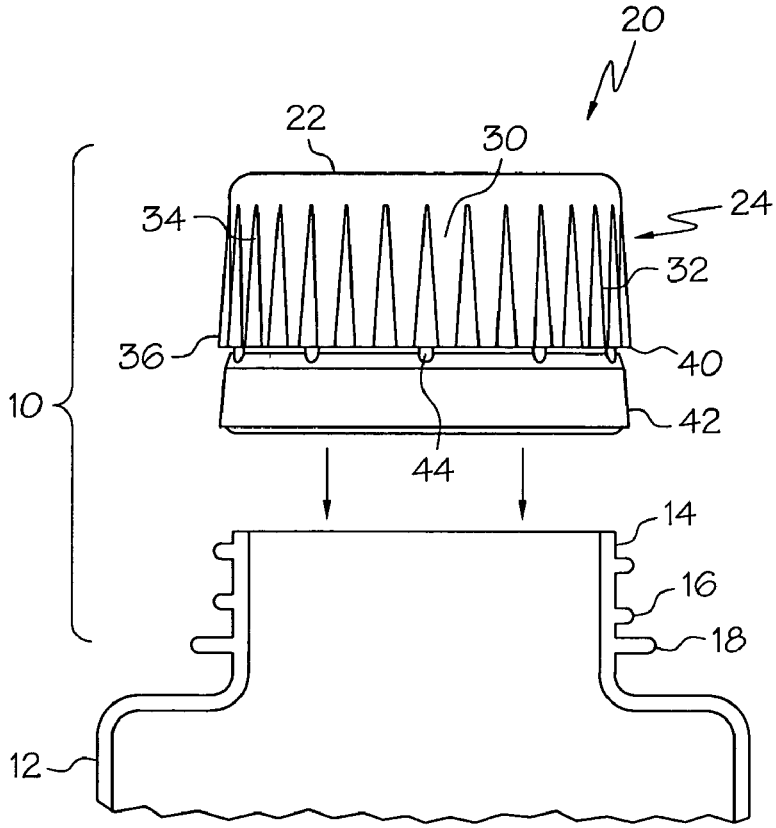
FIG. 1 is a fragmentary diagrammatical depiction of a packaging assembly that is constructed according to a preferred embodiment of the invention.

Referring now to the drawings, wherein like reference numerals designate corresponding structure throughout the views, a packaging assembly 10 that is constructed according to a preferred embodiment of the invention includes a container 12 of the type that has a finish portion 14 including at least one thread 16. In the preferred embodiment, container 12 further includes an annular projection 18 that is included for purposes of making the packaging assembly 10 tamper evident, in a manner that is well known in the industry. Preferably, container 12 is fabricated from a plastic material, such as polyethylene terephthalate, which is also known as PET. Packaging assembly 10 may be assembled and used to package a malt based consumer beverage, such as beer or ale, as will be discussed in greater detail below.

As may further be seen in FIG. 1, packaging assembly 10 includes a closure cap 20, which is preferably fabricated by a process such as injection molding from a plastic material such as polypropylene or polyethylene. Preferably, closure cap 20 is molded entirely from a plastic material, and contains no metal. Alternatively, a metal insert could be secured to the top of the closure cap 20 to further create an appearance that is suggestive of a metal crown. Closure cap 20 includes an upper portion 22 and a generally cylindrical sidewall 24 that is unitary with the upper portion 22 and depends downwardly therefrom, as is common in closures of this type. The generally cylindrical sidewall 24 has an inner surface 26 upon which a number of threads 28 are defined. The cylindrical sidewall 24 and the internal threads 28 are sized and shaped so that closure cap 20 may be screwed on to and screwed off of the finish portion 14 of container 12 in conventional fashion. In the preferred embodiment, a tamper evident band 42 is initially secured to the lower rim of the cylindrical sidewall 24 by means of a number of frangible elements 44. Alternatively, the tamper evident band 42 may be defined with respect to the rest of the closure by introducing a predetermined path of separation through slitting, scoring or a similar process. As is conventional, the tamper evident band is constructed so as to be able to slip over the annular ring 18 on the finish portion 14 during initial installation of the closure cap 20 on to the container 12, and so as to become separated from the closure cap 20 when the closure cap 20 is first unscrewed from the container 12 by a consumer.

Figure 2:
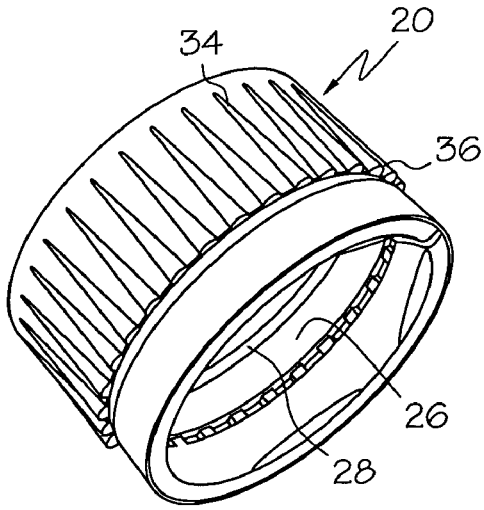
FIG. 2 is a perspective view of a closure cap that is part of the embodiment that is depicted in FIG. 1.
Figure 3:
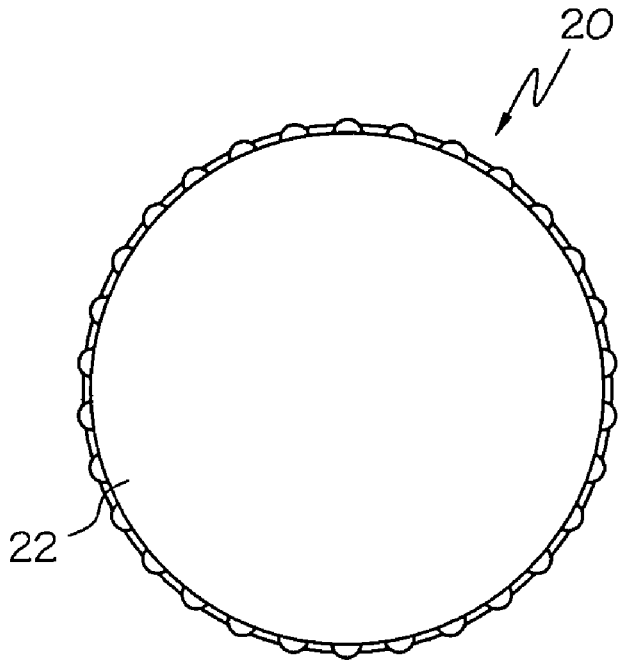
FIG. 3 is a top plan view of the closure cap that is shown in FIG. 2.

According to one particularly advantageous aspect of the invention, the cylindrical sidewall 24 has an outer surface 30 that is stylized so as to give the closure cap 20 an appearance that is reminiscent of a conventional crown closure of the type that is conventionally used to seal glass beer bottles. As may be seen in FIGS. 1 and 2, the outer surface 30 has in the preferred embodiment a plurality of axially extending fluted ribs 32 evenly spaced around the periphery thereof. The fluted ribs 32 are designed to create a visual effect that is similar to a familiar metal crimp pattern that occurs on a conventional crown closure that has been used to seal a bottle, such as a beer bottle. Each of the ribs 32 has an upper end 34 and a lower end 36, and is shaped so as to project radially outwardly more at the lower end than at the upper end. As may best be seen in FIGS. 1 and 2, the ribs 32 are reduced in thickness at the upper ends 34 so as to gradually merge into the outer surface 30. The lower ends 36 terminate near the lower rim of the cylindrical sidewall 24, and are preferably shaped and sized to extend sufficiently radially outwardly so that a consumer may feel the ribs 32 and feel a relatively sharp outer corner 40 of the ribs at their respective lower ends 36. The term "sharp" in this sense is intended to describe an edge that is shaped so as to be felt by a consumer as an edge, rather than a rounded surface, and is not intended to describe an edge that is so sharp that it would tend to cause injury to a consumer.

Figure 4:
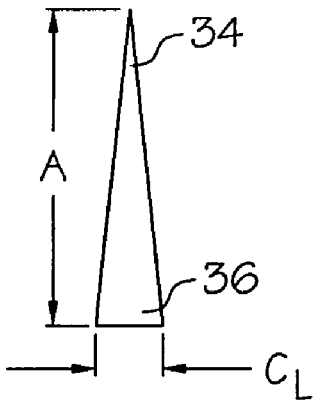
FIG. 4 is a diagrammatical depiction of one portion of the closure cap that is shown in FIGS. 2 and 3.
Figure 5:
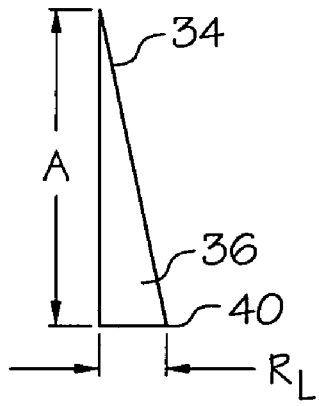
FIG. 5 is a different diagrammatical depiction of the same portion of the closure cap that is shown in FIG. 4.

As may be seen in FIG. 4, which is a diagrammatical depiction of a single rib 32 as it would be seen from a position that is directly radially outwardly from the rib 32, the rib 32 has an overall axial height A and a maximum circumferential width $C_L$ at the lower end 36. In order to successfully create a design effect that is suggestive of a metal crown, the overall actual height A should preferably be minimized. Preferably, the height A should be less than about 0.600 inches, and more preferably it should be 0.450 inches or less. The maximum circumferential width $C_L$ is preferably kept at a percentage of the overall circumference of the closure so as to resemble as closely the corresponding proportions of a conventional metal crown closure. In one embodiment of the invention that has been constructed, $C_L$ was 0.139 inches. Preferably, $C_L$ will be within the range of about 0.080 inches to about 0.200 inches for most closures constructed according to the invention. As may be seen in FIG. 5, which is a side profile depiction of one of the ribs 32, each rib 32 further has a maximum radial extension or depth $R_L$. Preferably, this depth $R_L$ will be kept at a percentage of the overall diameter of the closure so as to resemble closely the corresponding proportions of a conventional metal crown closure. For most closures constructed according to the invention, $R_L$ will be within the range of about 0.025 inches to about 0.75 inches, and more preferably within a range of about 0.030 inches to about 0.055 inches.

A method of packaging a beverage according to a preferred embodiment of the invention would includes steps of providing the container 12, providing the closure cap 20, at least partially filling the container 12 with a beverage, such as beer, and then installing the closure cap 20 on to the finish portion 14 of the container 12. The invention further includes a method of marketing a malt based beverage to consumers including steps of packaging the malt based beverage in a plastic container 12 that is sealed with a twist-on twist-off closure cap 20 that is designed to have and has an appearance that is reminiscent of a conventional metal crown closure normally used to seal beer bottles.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of packaging a beverage, comprising:

(a) providing a container that has a threaded finish portion;

(b) providing a closure cap having an upper portion and a generally cylindrical sidewall depending downwardly from said upper portion, said cylindrical sidewall defining a threaded inner surface, and wherein said cylindrical sidewall further has an outer surface that is stylized to resemble a conventional crown closure;

(c) at least partially filling the container with a beverage; and (d) installing the closure cap on to the finish portion of the container; wherein step (b) is performed by providing a closure cap that has a tamper evident band frangibly attached to a lower end thereof, and wherein step (d) is performed so as to secure the tamper evident band relative to the container so that the tamper evident band will be separated from the closure cap when the closure cap is unscrewed from the container by a consumer.

2. A method of packaging a beverage according to claim 1, wherein step (a) is performed by providing a plastic container.

3. A method of packaging a beverage according to claim 1, wherein step (b) is performed by providing a closure cap that is molded from a plastic material.

4. A method of packaging a beverage according to claim 1, wherein step (b) is performed by providing a closure cap that is molded from a plastic material and that contains no metal.

5. A method of packaging a beverage according to claim 1, wherein said outer surface of said cylindrical sidewall includes a plurality of axially extending fluted ribs.

6. A method of packaging a beverage according to claim 5, wherein said fluted ribs are shaped so as to project radially outwardly more at respective lower ends thereof than at upper ends thereof.

7. A method of packaging a beverage according to claim 6, wherein said fluted ribs are reduced in thickness at the upper ends thereof so as to gradually merge into said outer surface of said cylindrical sidewall.

8. A method of packaging a beverage according to claim 6, wherein each of said fluted ribs terminates at a lower end thereof that is positioned near a lower rim of the cylindrical sidewall.

9. A method according to claim 8, wherein said lower ends of said fluted ribs are shaped and sized to extend sufficiently radially outwardly so that a consumer may feel the ribs and feel a relatively sharp outer corner of the ribs at their respective outer ends.

10. A method of packaging a beverage, comprising:

(a) providing a container that has a threaded finish portion;

(b) providing a twist-on-twist-off closure cap having an upper portion and a generally cylindrical sidewall depending downwardly from said upper portion, said cylindrical sidewall defining a threaded inner surface, wherein the cylindrical sidewall and the internal threads being sized and shaped so that said twist-on-twist-off closure cap is screwable onto and off of the finish portion of the container in conventional fashion, and wherein said cylindrical sidewall further has an outer surface that is stylized to resemble a conventional crown closure;

(c) at least partially filling the container with a beverage; and (d) installing the twist-on-twist-off closure cap on the finish portion of the container.

11. A method of packaging a beverage, comprising:

(a) providing a container that has a threaded finish portion;

(b) providing a twist-on-twist-off closure cap that is molded from a plastic material and that contains no metal, said closure cap having a continuous upper portion and a continuous generally cylindrical sidewall depending downwardly from said upper portion, said cylindrical sidewall defining a threaded inner surface, wherein the course of the thread is helically wound, and wherein said cylindrical sidewall further has an outer surface that is stylized to resemble a conventional crown closure;

(c) at least partially filling the container with a beverage; and (d) installing the twist-on-twist-off closure cap on the finish portion of the container.

12. A method of packaging a beverage, comprising:

(a) providing a container that has a threaded finish portion;

(b) providing a twist-on-twist-off closure cap that is molded from a plastic material and that contains no metal, said closure cap having a continuous upper portion and a continuous generally cylindrical sidewall depending downwardly from said upper portion, said cylindrical sidewall defining a threaded inner surface, and wherein said cylindrical sidewall further has an outer surface that is stylized to resemble a conventional crown closure, the closure cap having no hinge;

(c) at least partially filling the container with a beverage; and (d) installing the twist-on-twist-off closure cap on the finish portion of the container.

13. A method of packaging a beverage, comprising:

(a) providing a container that has a threaded finish portion;

(b) providing a twist-on-twist-off closure cap that is molded from a plastic material and that contains no metal, said closure cap having a continuous upper portion and a continuous generally cylindrical sidewall depending downwardly from said upper portion, said cylindrical sidewall defining a threaded inner surface and wherein said cylindrical sidewall further has an outer surface that is stylized to resemble a conventional crown closure, the closure cap having no line of weakness in the cylindrical sidewall;

(c) at least partially filling the container with a beverage; and (d) installing the twist-on-twist-off closure cap on the finish portion of the container.

14. A method according to claim 13, wherein step (b) is performed by providing a closure cap that has a tamper evident band frangibly attached to a lower end thereof, and wherein step (d) is performed so as to secure the tamper evident band relative to the container so that the tamper evident band will be separated form the closure cap when the closure cap is unscrewed from the container by a consumer.

15. A method of packaging a beverage, comprising:

(a) providing a container that has a threaded finish portion;

(b) providing a twist-on-twist-off closure cap that is molded from a plastic material and that contains no metal, said closure cap having a continuous upper portion and a continuous generally cylindrical sidewall depending downwardly from said upper portion, said cylindrical sidewall defining a threaded inner surface and wherein said cylindrical sidewall further has an outer surface that is stylized to resemble a conventional crown closure, the closure cap having no handle;

(c) at least partially filling the container with a beverage; and (d) installing the twist-on-twist-off closure cap on the finish portion of the container.

16. A method of packaging a beverage, comprising:

(a) providing a container that has a threaded finish portion;

(b) providing a twist-on-twist-off closure cap that is molded from a plastic material and that contains no metal, said closure cap having a continuous upper portion and a continuous generally cylindrical sidewall depending downwardly from said upper portion, said cylindrical sidewall defining a threaded inner surface and wherein said cylindrical sidewall further has an outer surface that is stylized to resemble a conventional crown closure, the closure cap having no flaps on the inner surface of the sidewall that engage a stopping face in circumferential direction on the container;

(c) at least partially filling the container with a beverage; and (d) installing the twist-on-twist-off closure cap on the finish portion of the container.

17. A method of packaging a beverage, comprising:

(a) providing a container that has a threaded finish portion;

(b) providing a twist-on-twist-off closure cap that is molded from a plastic material and that contains no metal, said closure cap having a continuous upper portion and a continuous generally cylindrical sidewall depending downwardly from said upper portion, said cylindrical sidewall defining a threaded inner surface and wherein said cylindrical sidewall further has an outer surface that is stylized to resemble a conventional crown closure, the closure constructed such that it may be opened from the fully closed position by screwing, (c) at least partially filling the container with a beverage; and (d) installing the twist-on-twist-off closure cap on the finish portion of the container.

18. A method of packaging a beverage, comprising:

(a) providing a container that has a threaded finish portion;

(b) providing a twist-on-twist-off closure cap that is molded from a plastic material and that contains no metal, sad closure cap having a continuous upper portion and a continuous generally cylindrical sidewall depending downwardly from said upper portion, said cylindrical sidewall defining a threaded inner surface and wherein said cylindrical sidewall further has an outer surface that is stylized to resemble a conventional crown closure, the closure construed such that it may be opened from the fully closed position without destroying the outer surface;

(c) at least partially filling the container with a beverage; and (d) installing the twist-on-twist-off closure cap on the finish portion of the container.

* * * * *